United States Patent [19]

Seese et al.

[11] 4,185,999

[45] Jan. 29, 1980

[54] BARIUM-STRONTIUM-SILICON-ALUMINUM MASTER ALLOY

[75] Inventors: Robert G. Seese, Youngstown; Alan Fitzgibbon, Lewiston; Frank Slish, Grand Island, all of N.Y.

[73] Assignee: Union Carbide Corporation, New York, N.Y.

[21] Appl. No.: 911,095

[22] Filed: May 31, 1978

[51] Int. Cl.[2] ..... C22C 21/02

[52] U.S. Cl. ..... 75/148; 75/134 S; 148/32

[58] Field of Search ..... 75/148, 68 R, 134 A, 75/134 S; 148/32

[56] References Cited

U.S. PATENT DOCUMENTS

| | | | |
|---|---|---|---|
| 1,657,389 | 1/1928 | Gwyer et al. | 75/148 |
| 3,128,176 | 4/1964 | Martin | 75/148 |
| 3,466,170 | 9/1969 | Dunkel et al. | 75/148 |
| 3,567,429 | 3/1971 | Dunkel et al. | 75/148 |
| 3,649,253 | 3/1972 | Kaess | 75/134 S |
| 3,811,177 | 5/1974 | Schoer et al. | 75/148 |
| 4,009,026 | 2/1977 | Rasmessen | 75/148 |

*Primary Examiner*—R. Dean

*Attorney, Agent, or Firm*—J. Hart Evans

[57] ABSTRACT

A master alloy containing barium, strontium, silicon and aluminum for modification of the aluminum-silicon eutectic phase of eutectic and hypoeutectic aluminum-silicon casting alloys.

4 Claims, 16 Drawing Figures

BARIUM-STRONTIUM-SILICON-ALUMINUM MASTER ALLOY

The present invention relates to master alloys for the modification of aluminum-silicon casting alloys. More particularly, the present invention is related to a master alloy containing barium, strontium, silicon and aluminum for modifying the aluminum-silicon eutectic phase of eutectic and hypoeutectic aluminum-silicon casting alloys.

Strontium, as is known in the art, e.g. U.S. Pat. No. 4,009,026—R. T. C. Rasmussen, is an effective modifier of the aluminum-silicon eutectic phase in hypoeutectic and eutectic aluminum-silicon casting alloys (less than 12.6% by weight silicon). The above-noted patent describes a strontium-silicon-aluminum master alloy containing between 3 and 28% strontium which is added to silicon-aluminum casting alloys to modify the alloy and provide in the resulting castings a permanent modified eutectic microcrystalline structure. However, while the aforementioned master alloy may provide effective modification of the casting alloy, the amount of strontium initially retained in the casting alloy melt is less than desired, and for extended holding periods, i.e. the time period between addition of the master alloy modifier to the molten alloy and the casting of the molten alloy, the strontium content of the melt further "fades", i.e. decreases, significantly. This loss of strontium during the holding period can require the use of increased quantities of master alloy in order to maintain a desirable level of strontium.

It is therefore an object of the present invention to provide a strontium containing master alloy for modifying aluminum casting alloys which provides a consistently high recovery of strontium in molten aluminum casting alloys and minimal fade of the strontium content in the casting alloy melt.

Other objects will be apparent from the following description and claims taken in conjunction with the drawing herein FIG. 1(*a*) is a photomicrograph (150×) of an unmodified 9% silicon, 91% aluminum hypoeutectic casting alloy showing the undesirable needle-like structure which results in poor machinability and mechanical properties.

FIGS. 1(*b*) and 1(*c*) are photomicrographs (150×) of a 9% silicon, 91% aluminum casting alloy which was modified to have a desirable modified structure of aluminum-silicon eutectic by the addition of 0.04% strontium in the form of a prior art master alloy containing 10% strontium, 14% silicon, balance essentially aluminum. The holding period was one hour for FIG. 1(*b*) and two hours for FIG. 1(*c*).

FIG. 1(*d*) is a photomicrograph (150×) of the modified alloy of FIG. 1(*c*) which has been remelted and resolidified and has retained the desired modified structure.

FIGS. 1(*e*) and 1(*f*) are photomicrographs (150×) of a 9% silicon, 91% aluminum casting alloy which was modified by the addition of 0.04% strontium in the form of a master alloy in accordance with the present invention containing 2.5% barium, 23.5% silicon, 10% strontium balance essentially aluminum. The holding period was one hour for FIG. 1(*e*) and two hours for FIG. 1(*f*). The structure of the casting alloy as can be seen from the photomicrograph was effectively modified to have a desirable modified structure of aluminum-silicon eutectic.

FIG. 2(*b*) is a graph showing, for a 0.04% strontium addition, strontium recovery and retention in a casting alloy (9% Si, 91% Al) modified by master alloys (10% Sr, 13% Si+Al) containing various amounts of barium.

FIG. 2(*c*) is a graph comparing, for strontium additions of 0.04%, strontium recovery and retention for barium containing master alloys of the present invention, with a prior art type master alloy without barium.

Figure 1A:
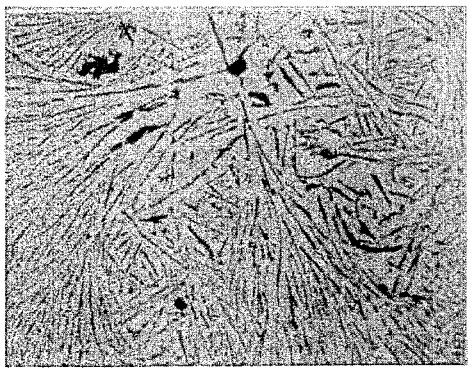
FIG. 1(*g*) is a photomicrograph (150×) of the modified alloy of FIG. 1(*f*) which has been remelted and resolidified and has retained the desired microstructure.
Figure 1D:
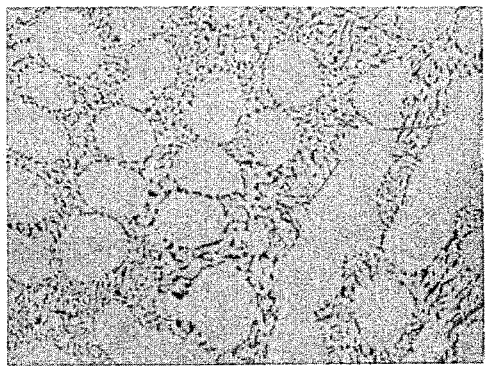
Figure 1B:
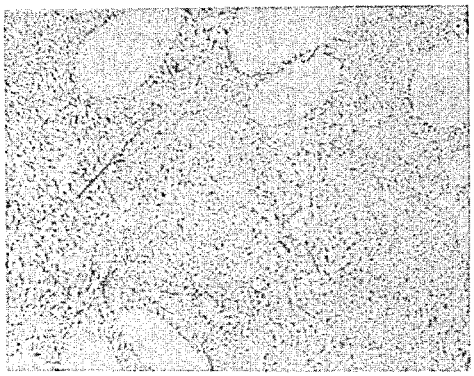
Figure 1C:
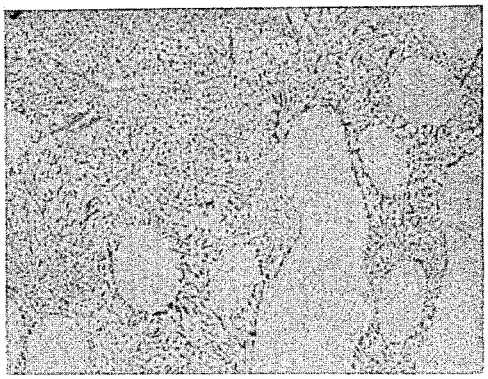
Figure 1E:
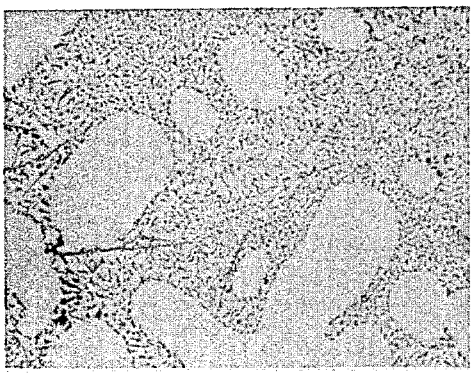
Figure 1F:
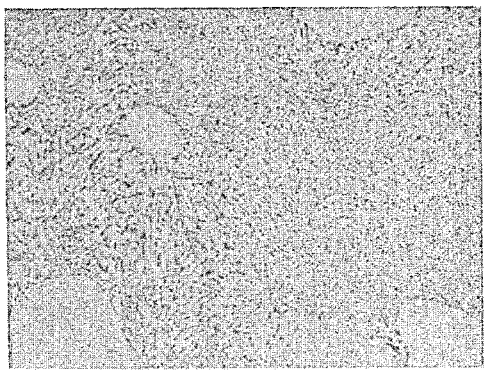
Figure 1G:
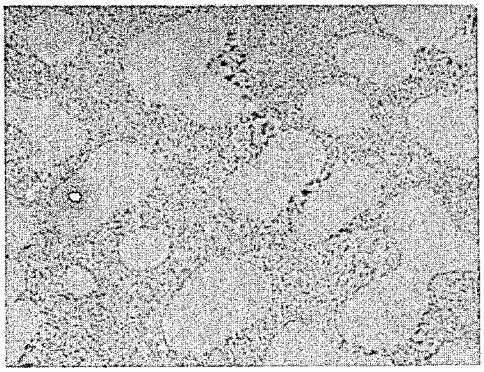

FIGS. 3(*a*) and 3(*b*) are photomicrographs (150×) of a 9% silicon, 91% aluminum casting alloy which was modified by the addition of 0.01% strontium in the form of a master alloy in accordance with the present invention containing 2.65% barium, 22.65% silicon, 9.8% strontium balance essentially aluminum. The holding period was one hour for FIG. 3(*a*) and two hours for FIG. 3(*b*).

FIGS. 4(*a*) and 4(*b*) are photomicrographs (150×) of a 9% silicon, 91% aluminum casting alloy which was modified by the addition of 0.01% strontium in the form of a prior art master alloy without barium. The holding period was one hour for FIG. 4(*a*) and two hours for FIG. 4(*b*).

FIGS. 5(*a*) and 5(*b*) are photomicrographs (150×) of a 9% silicon, 91% aluminum casting alloy which was modified by the addition of 0.015% strontium in the form of a prior art master alloy without barium. The holding period was one hour for FIG. 5(*a*) and two hours for FIG. 5(*b*).

A master alloy in accordance with the present invention consists essentially of by weight about 1.25 to 4.5% barium, 8 to 15% strontium, 10 to 25% silicon balance essentially aluminum, with the strontium to barium ratio by weight being from about 9.6:1 to 2.25:1.

A preferred master alloy in accordance with the present invention contains from 3 to 4% barium, 10 to 15% silicon, 9 to 11% strontium, with the strontium to barium ratio being from about 2.5:1 to 3.3:1.

A particularly preferred master alloy in accordance with the present invention contains about 18 to 25% silicon, 9 to 11% strontium, 2 to 4% barium, with the strontium to barium ratio being from about 2.5:1 to 5:1.

The Ba-Sr-Si-Al master alloy in accordance with the present invention is readily made using known techniques by adding a commercially available Sr-Ba-Si alloy (25–40% Sr, 3.5–17% Ba, 40–60% Si) to molten aluminum or aluminum-silicon alloy containing up to 10% silicon at a temperature of about 1100° C. in proportions to provide the master alloy of the present invention. The master alloy of the present invention may contain up to about 1% of calcium as an incidental impurity and incidental amounts, up to about 1% in the aggregate of iron, manganese, zirconium and titanium.

As can be seen from the photomicrogaphs of FIGS. 1(*e*)–1(*g*) the relatively high barium content of the master alloy addition of the present invention does not interfere with the modifying effect of strontium since the high barium content master alloy of the present invention provides desirable modification at least to the same extent as the prior art master alloys used in connection with FIGS. 1(*b*)–1(*d*). The graphs of FIGS. 2(*a*) and 2(*b*) show that for barium contents in accordance with the present invention there is at least about 80% retention of added strontium, initially and for holding periods up to two hours, with particularly high strontium recoveries for barium contents of from about 2 to 4% at the higher silicon contents as shown in FIG. 2(*a*), and for barium contents of from about 3 to 4% at the lower silicon contents as shown in FIG. 2(*b*). The data, on which the graphs of FIGS. 2(*a*) and 2(*b*) are based, are shown in Tables I and II respectively. The master alloys of Tables I and II were used to modify 9% Si, 91% Al hypoeutectic casting alloys.

Figure 2A:
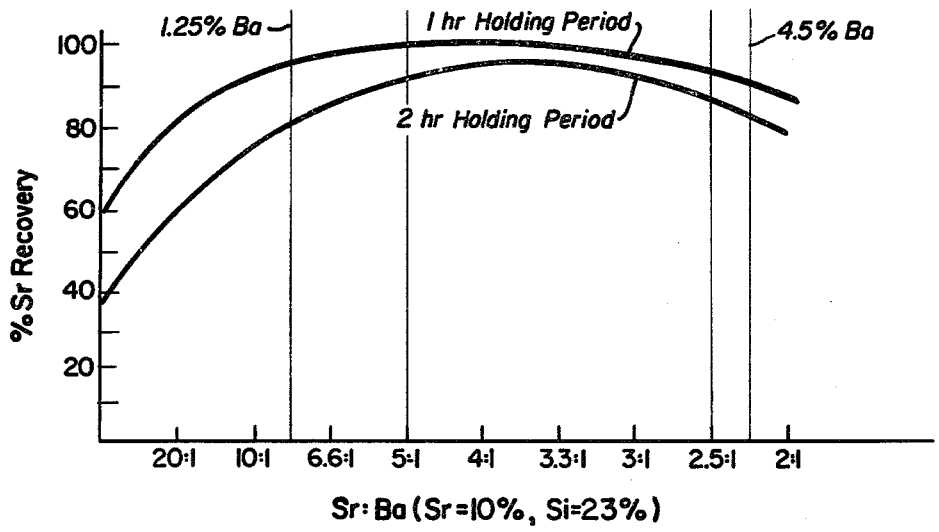
FIG. 2(*a*) is a graph showing, for a 0.04% strontium addition, strontium recovery and retention in a casting alloy (9% Si, 91% Al) modified by master alloys (10% Sr, 23% Si+Al) containing various amounts of barium.

TABLE I (FIG. 2(a))
23% Si, 10% Sr + Al Base Alloy

| Barium Level In Base Alloy | Sr Recovery by Analysis of 0.04% Addition: 1 Hr. Holding Period | 2 Hr. Holding Period |
|---|---|---|
| O* - Ba Ht. No. H386 | 57.5% | 37.5% |
| 20:1 - Sr:Ba Ht. No. H912 | 90.5% | 69.0% |
| 10:1 - Sr:Ba Ht. No. H913 | 97.2% | 80.6% |
| 6.6:1 - Sr:Ba Ht. No. H914 | 95.6% | 82.6% |
| 5:1 - Sr:Ba Ht. No. H915 | 102.4%** | 90.5% |
| 3.3:1 - Sr:Ba Ht. No. H916 | 97.6% | 97.6% |
| 2.5:1 - Sr:Ba Ht. No. H917 | 95.3% | 88.4% |

*Approx. 0.35% Ba typical impurity level.
**Recovery essentially 100%.

Figure 2B:
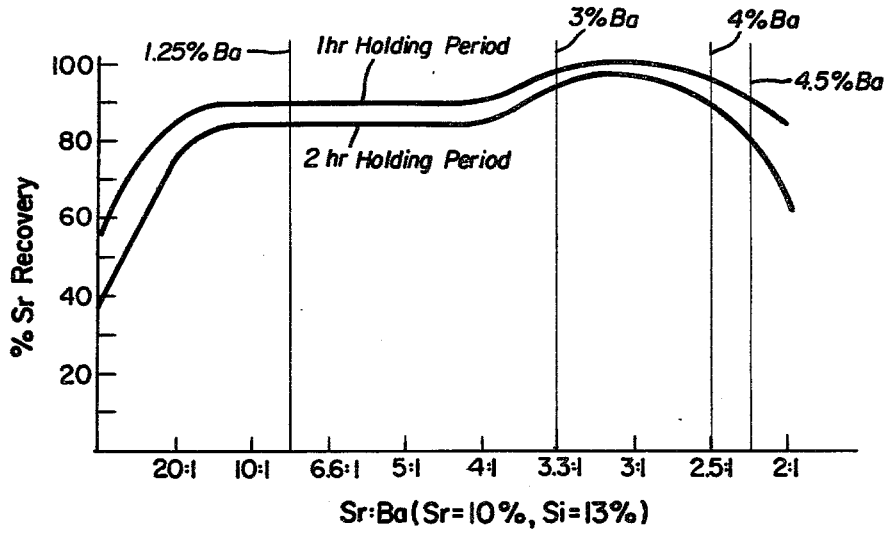

TABLE II (FIG. 2(b))
13% Si, 10% Sr + Al Base Alloy

| Barium Level in Base Alloy | Sr Recovery by Analysis of 0.04% Addition: 1 Hr. Holding Period | 2 Hr. Holding Period |
|---|---|---|
| 20:1 Ht. No. H949 | 93.6% | 85.1% |
| 10:1 Ht. No. H950 | 95.0% | 90.0% |
| 6.6:1 Ht. No. H920 | 86.7% | 82.2% |
| 5:1 Ht. No. H921 | 90.9% | 81.8% |
| 4:1 Ht. No. H922 | 78.9%* | 81.6% |
| 3.3:1 Ht. No. H923 | 100.0% | 97.1% |
| 2.5:1 Ht. No. H924 | 97.6% | 92.9% |
| 2:1 Ht. No. H925 | 82.9% | 63.4% |

*Reported analysis.

FIG. 2(*c*) shows that a particularly preferred barium containing (3% BA) master alloy in accordance with the present invention has more than 90% initial strontium recovery and 80% Sr retention for holding periods up to two hours while the master alloy containing less than 1% barium had an initial Sr recovery of only about 68% which faded to less than 40% after a holding period of two hours. The data on which the graphs of FIG. 2(*c*) are based is shown in Table III. The master alloys of Table III were used to modify 9% Si, 91% Al casting alloys.

Figure 2C:
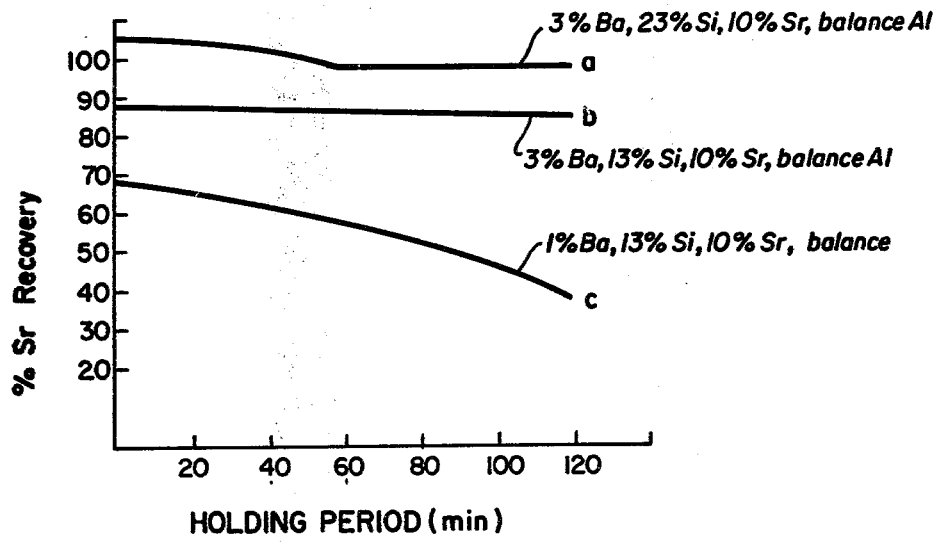

TABLE III (FIG. 2(c))

| Heat No. | Wt. % Si | Sr:Ba Ratio | % Sr | Sr % Recovery by Analysis of 0.04% Addition-Holding Period: 2 min. | 20 min. | 60 min. | 120 min. |
|---|---|---|---|---|---|---|---|
| H916(a) | 23 | 3.3:1 | 9.80 | 105.0 | 104.8 | 97.6 | 97.6 |
| H923(b) | 13 | 3.3:1 | 10.72 | 87.5 | 82.5 | 87.5 | 85.0 |
| H386(c) | 13 | No Ba* | 10.30 | 67.5 | — | 57.5 | 37.5 |

*Less than 1%.

The casting alloys modified with the master alloys of Tables I, II and III had the desirable structures, e.g. of the type as shown in FIGS. 1(*b*)–1(*g*); however, as indicated in Table I–Table III and FIG. 3(*a*) particularly, substantially less of the barium containing master alloy of the present invention can be used in view of the substantially higher Sr recoveries indicated. As shown in FIGS. 4(*a*) and 4(*b*), when the prior art type master alloy (less than 1% barium) is used in amounts which provide a 0.01% Sr addition, the desired modified structure is not obtained at holding periods of one hour whereas a 0.01% Sr addition using the barium containing master alloy of the present invention (2.65% Ba) does provide desired modified structure for holding periods of two hours as shown in FIGS. 3(*a*) and 3(*b*). FIGS. 5(*a*) and 5(*b*) indicate that, after a 0.015% addition of the prior art type master alloy (less than 1% barium) is made, the desired modified structure is partially lost after a holding period of 1 hour and almost completely lost after a holding period of 2 hours. The data corresponding to FIGS. 3(*a*), 3(*b*), 4(*a*), 4(*b*), 5(*a*) and 5(*b*) is shown in Table IV.

TABLE IV

[Figures 3(a), 3(b), 4(a), 4(b), 5(a) and 5(b)]

Figure 3A:
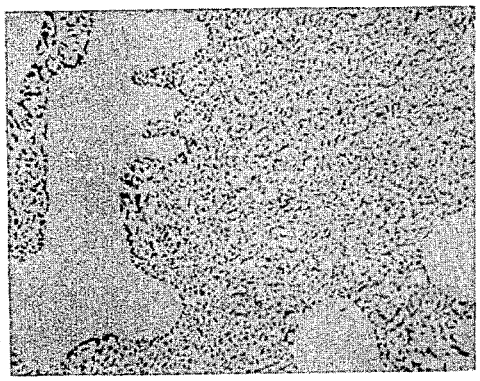
Figure 3B:
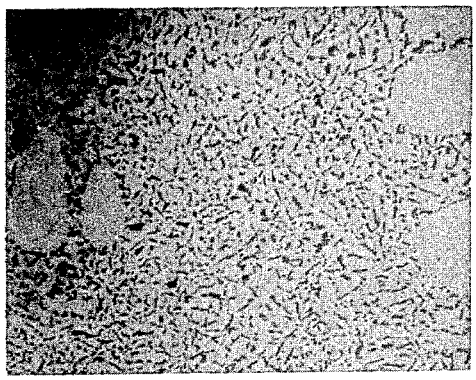
Figure 4A:
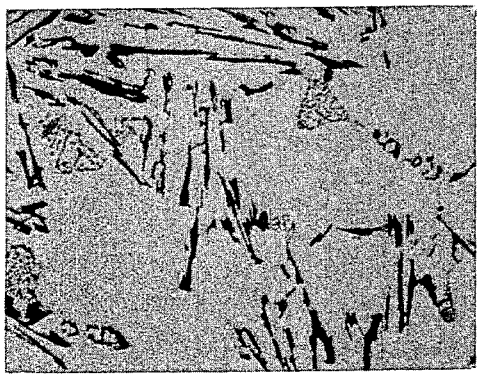
Figure 4B:
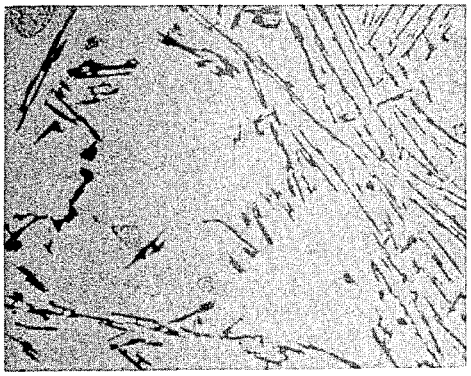
Figure 5A:
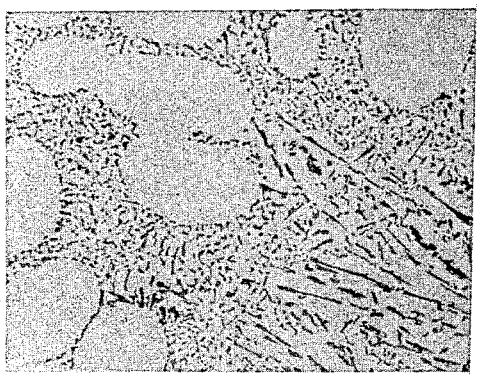
Figure 5B:
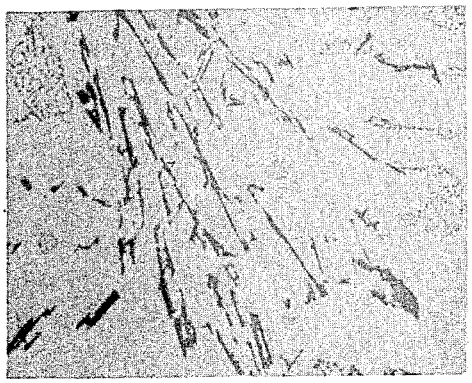

| Heat No. | Wt. % Si | Sr:Ba Ratio | Wt. % Sr | % Sr Addition | Sr Recovery-Holding Period: 2 Min. | 60 Min. | 120 Min. | |
|---|---|---|---|---|---|---|---|---|
| J54 | 22.65 | 3.7:1 | 9.80 | .010 | .010 | .008 | .009 | [Figures 3(a) & 3(b)] |
| J56 | " | No Ba* | 9.98 | .010 | .009 | .002 | .004 | [Figures 4(a) & 4(b)] |
| J57 | " | No Ba* | 9.98 | .015 | .014 | .009 | .006 | [Figures 5(a) & 5(b)] |

*Less than 1%.

As can be seen, substantially less of the barium containing master alloy of the present invention is required to provide the desired modified structure in aluminum casting alloys.

What is claimed is:

1. A master alloy for modifying eutectic and hypoeutectic aluminum-silicon alloys said master alloy consisting essentially of from about 1.25 to 4.5% barium, 8 to 15% strontium, 10 to 25% silicon balance aluminum and incidental impurities, the ratio of strontium to barium being from about 9.6:1 to 2.25:1.

2. A master alloy in accordance with claim 1 containing from about 3 to 4% barium, 10 to 15% silicon, 9 to 11% strontium and having a ratio of strontium to barium of about 2.5:1 to 3.3:1.

3. A master alloy in accordance with claim 1 containing from about 2 to 4% barium, 18 to 25% silicon, 9 to 11% strontium and having a ratio of strontium to barium of about 2.5:1 to 5:1.

4. Method for modifying the aluminum-silicon eutectic and hypoeutectic aluminum silicon casting alloys which comprises providing a melt of such casting alloy and adding thereto a master alloy consisting essentially of from about 1.25 to 4.5% barium, 8 to 15% strontium, 10 to 25% silicon balance aluminum and incidental impurities, the ratio of strontium to barium being from about 9.6:1 to 2.25:1.

* * * * *